US008887984B2

(12) United States Patent
Bahr

(10) Patent No.: US 8,887,984 B2
(45) Date of Patent: Nov. 18, 2014

(54) TRAY FOR SUPPORTING CONTAINERS AND A BLANK FOR MAKING THE SAME

(75) Inventor: Dave Wayne Bahr, Columbia, IL (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 591 days.

(21) Appl. No.: 13/094,398

(22) Filed: Apr. 26, 2011

(65) Prior Publication Data

US 2012/0273383 A1 Nov. 1, 2012

(51) Int. Cl.
*B65D 5/482* (2006.01)
*B65D 5/50* (2006.01)
*B65D 71/54* (2006.01)

(52) U.S. Cl.
CPC .. *B65D 71/0007* (2013.01); *B65D 2571/00141* (2013.01); *B65D 2571/0066* (2013.01); *B65D 5/5021* (2013.01); *B65D 2571/00796* (2013.01); *B65D 2571/00308* (2013.01); *Y10S 229/904* (2013.01)
USPC ..... 229/120.15; 229/120.16; 229/904

(58) Field of Classification Search
CPC .. B65D 5/4802; B65D 5/2095; B65D 5/5021; B65D 5/5007
USPC ..... 229/120.15, 120.16, 120.14, 165, 904; 206/564, 565, 485, 526
See application file for complete search history.

(56) References Cited

U.S. PATENT DOCUMENTS 2,501,609 A * 3/1950 Midouhas ..... 206/449
2,817,473 A 12/1957 Foster
3,174,674 A * 3/1965 Wagner ..... 206/564
3,314,530 A * 4/1967 Michalka ..... 206/756
3,366,305 A 1/1968 Cohen et al.
3,606,004 A * 9/1971 Fruehwirth ..... 206/423
3,688,969 A 9/1972 Gabarez
3,696,940 A 10/1972 Hoffman et al.
3,861,530 A 1/1975 Calvert
3,971,472 A * 7/1976 Veenman ..... 206/590
4,156,484 A 5/1979 Wischusen
4,526,315 A * 7/1985 Muise ..... 229/120.15
4,787,509 A 11/1988 Pasternicki
5,348,218 A * 9/1994 Haire et al. ..... 229/117.07
5,553,704 A 9/1996 Gordon et al.
6,474,473 B2 11/2002 Wong
7,571,807 B2 8/2009 DeBusk et al.
8,281,927 B2 * 10/2012 Smith ..... 206/485
2006/0157368 A1 7/2006 Kraft

FOREIGN PATENT DOCUMENTS

DE 202006013260 10/2006
DE 202006017722 2/2007

(Continued)

*Primary Examiner* — Justin Larson
*Assistant Examiner* — Phillip Schmidt
(74) *Attorney, Agent, or Firm* — Armstrong Teasdale LLP

(57) ABSTRACT

A blank for forming a tray includes a bottom panel, end panels, and side panels. A first divider panel assembly is defined within the bottom panel and an end panel. The first divider panel assembly includes an upper panel defined within the end panel and an inner panel defined within the bottom panel. The upper panel is configured to be at an angle to the bottom panel, and the inner panel is configured to be at an angle to the end panel in an erected configuration. A second divider panel assembly is defined within the bottom panel and a side panel. The second divider panel assembly includes an upper panel defined within the side panel and an inner panel is defined within the bottom panel. The panels of the second divider panel assembly are configured similarly to the panels of the first divider panel assembly in the erected configuration.

26 Claims, 12 Drawing Sheets

(56) References Cited

FOREIGN PATENT DOCUMENTS

| | | | | |
|---|---|---|---|---|
| EP | 0103535 | B1 | | 3/1984 |
| EP | 133957 | A | * | 3/1985 |
| EP | 0177911 | B1 | | 4/1986 |
| FR | 2596972 | A1 | * | 10/1987 |
| FR | 2659624 | A1 | * | 9/1991 |
| GB | 1376597 | A | * | 12/1974 |
| JP | 2004043002 | A | * | 2/2004 |

* cited by examiner

TRAY FOR SUPPORTING CONTAINERS AND A BLANK FOR MAKING THE SAME

BACKGROUND OF THE INVENTION

The embodiments described herein relate generally to a tray formed from a blank of sheet material and, more particularly, to a tray for supporting a plurality of containers included within the tray.

At least some known trays are configured to hold a plurality of containers therein. Most of these known trays are formed from a relatively large blank having a plurality of panels that fold and/or wrap to define container holders. More specifically, the plurality of panels form a rectangular tube having cutouts into which the containers are inserted. Because these trays are formed from a relatively large blank of sheet material they can be expensive to make. Moreover, because of the plurality of panels, they can be complicated to form.

Another known tray includes single-thickness side and end walls having a cup holder that extends outwardly from each end wall. The end walls of such a tray include side flaps that couple to an adjacent side wall. The end walls and side flaps are taller than the side walls. As such, when a cup is positioned in the tray, the cup is secured by the combination of the cup holder, the end wall, and the side flap. Notably, the retractable cup holders only extend from the end walls because the end wall and side flap cooperate with the cup holder to secure the cup in the tray. Further, the central portion of the tray is configured to allow for other food items to be positioned therein. As such, this other known tray is limited in the number of containers it is able to support therein.

BRIEF DESCRIPTION OF THE INVENTION

In one aspect, a blank for forming a tray is provided. The blank includes a bottom panel, a pair of opposing end panels connected to the bottom panel, and a pair of opposing side panels connected to the bottom panel. A first divider panel assembly is defined within the bottom panel and a first end panel of the pair of end panels. The first divider panel assembly includes a first upper panel and a first inner panel connected at a first fold line. The first upper panel is defined within the first end panel and the first inner panel is defined within the bottom panel. In an erect configuration, the first upper panel is configured to be at a first angle to the bottom panel, and the first inner panel is configured to be a second angle to the first end panel. A second divider panel assembly is defined within the bottom panel and a first side panel of the pair of side panels. The second divider panel assembly includes a second upper panel and a second inner panel connected at a second fold line. The second upper panel is defined within the first side panel, and the second inner panel is defined within the bottom panel. In the erect configuration, the second upper panel is configured to be at a third angle to the bottom panel, and the second inner panel is configured to be at a fourth angle to the first side panel.

In another aspect, a tray formed from a blank of sheet material is provided. The tray includes a bottom wall, a pair of opposing end walls connected to the bottom wall, and a pair of opposing side walls connected to the bottom walls. A first divider structure extends from the bottom wall and a first end wall of the pair of end walls. The first divider structure includes a first upper panel and a first inner panel connected at a first fold line. The first upper panel is at a first angle to the bottom wall, and the first inner panel is at a second angle to the first end wall. A second divider structure extends from the bottom wall and a first side wall of the pair of side walls. The second divider structure includes a second upper panel and a second inner panel connected at a second fold line. The second upper panel is at a third angle to the bottom wall, and the second inner panel is at a fourth angle to the first side wall.

In yet another aspect, a method for forming a tray from a blank of sheet material is provided. The blank of sheet material includes a bottom panel, a pair of opposing end panels connected to the bottom panel, a pair of opposing side panels connected to the bottom panel, a first divider panel assembly defined within the bottom panel and a first side panel of the pair of side panels, and a second divider panel assembly defined within the bottom panel and a first end panel of the pair of end panels. The first divider panel assembly includes a first upper panel defined within the first side panel and a first inner panel defined within the bottom panel. The second divider panel assembly includes a second upper panel defined within the first end panel and a second inner panel defined within the bottom panel. The method includes rotating the pair of side panels toward the bottom panel to form a pair of opposing side walls, rotating the first upper panel with respect to the first side panel and the first inner panel with respect to the bottom panel to form a first divider structure, rotating the pair of end panels toward the bottom panel to form a pair of opposing end walls, and rotating the second upper panel with respect to the first end panel and the second inner panel with respect to the bottom panel to form a second divider structure.

In still another aspect, a blank for forming a tray is provided. The blank includes a bottom panel, a pair of opposing end panels connected to the bottom panel, a pair of opposing side panels connected to the bottom panel, and a plurality of divider panel assemblies defined within the bottom panel and a first side panel of the pair of side panels. Each divider panel assembly of the plurality of divider panel assemblies includes an upper panel and an inner panel connected at a fold line. The upper panel is defined within the first side panel, and the inner panel is defined within the bottom panel. The upper panel is configured to be at a first angle to the bottom panel, and the inner panel is configured to be at a second angle to the first side panel in an erected configuration.

BRIEF DESCRIPTION OF THE DRAWINGS

FIG. 1 is a top view of an exemplary blank of sheet material for forming a tray.

FIG. 2 is a perspective view of the blank shown in FIG. 1 at a first stage of construction.

FIG. 3 is a perspective view of the blank shown in FIG. 1 at a second stage of construction.

FIG. 4 is a perspective view of the blank shown in FIG. 1 at a third stage of construction.

FIG. 5 is a perspective view of the blank shown in FIG. 1 at a fourth stage of construction.

FIG. 6 is a perspective view of an exemplary tray formed from the blank shown in FIG. 1.

FIG. 7 is a perspective view of the tray shown in FIG. 6 having products therein.

FIG. 8 is a top view of a first alternative blank of sheet material for forming a tray.

FIG. 9 is a perspective view of a tray formed from the blank shown in FIG. 8.

FIG. 10 is a perspective view of the tray shown in FIG. 9 having products therein.

FIG. 11 is a top view of a second alternative blank of sheet material for forming a tray.

FIG. 12 is a perspective view of a tray formed from the blank shown in FIG. 4 and having products therein.

DETAILED DESCRIPTION OF THE INVENTION

The embodiments described herein provide a tray configured to support and/or contain a plurality of containers and/or products. For example, the trays described herein can be used to contain a plurality of cylindrical and/or tub-shaped containers, such as dairy containers, during transport through an assembly line and/or to a store and/or during storage of the containers. An alternative tray is configured to contain a plurality of elongated products, such as cards and/or blister packs, during transport and/or storage.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

A tray formed from a single sheet of material and a method and machine for constructing the container is described herein. The tray may be constructed from a blank of sheet material using a machine. In one embodiment, the tray is fabricated from a cardboard material. The tray, however, may be fabricated using any suitable material, and therefore is not limited to a specific type of material. In alternative embodiments, the tray is fabricated using cardboard, plastic, fiberboard, paperboard, foamboard, corrugated paper, and/or any suitable material known to those skilled in the art and guided by the teachings herein provided.

In an example embodiment, the tray includes at least one marking thereon including, without limitation, indicia that communicates the product stored in the tray, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the tray is void of markings, such as, without limitation, indicia that communicates the product, a manufacturer of the product and/or a seller of the product.

Figure 1:
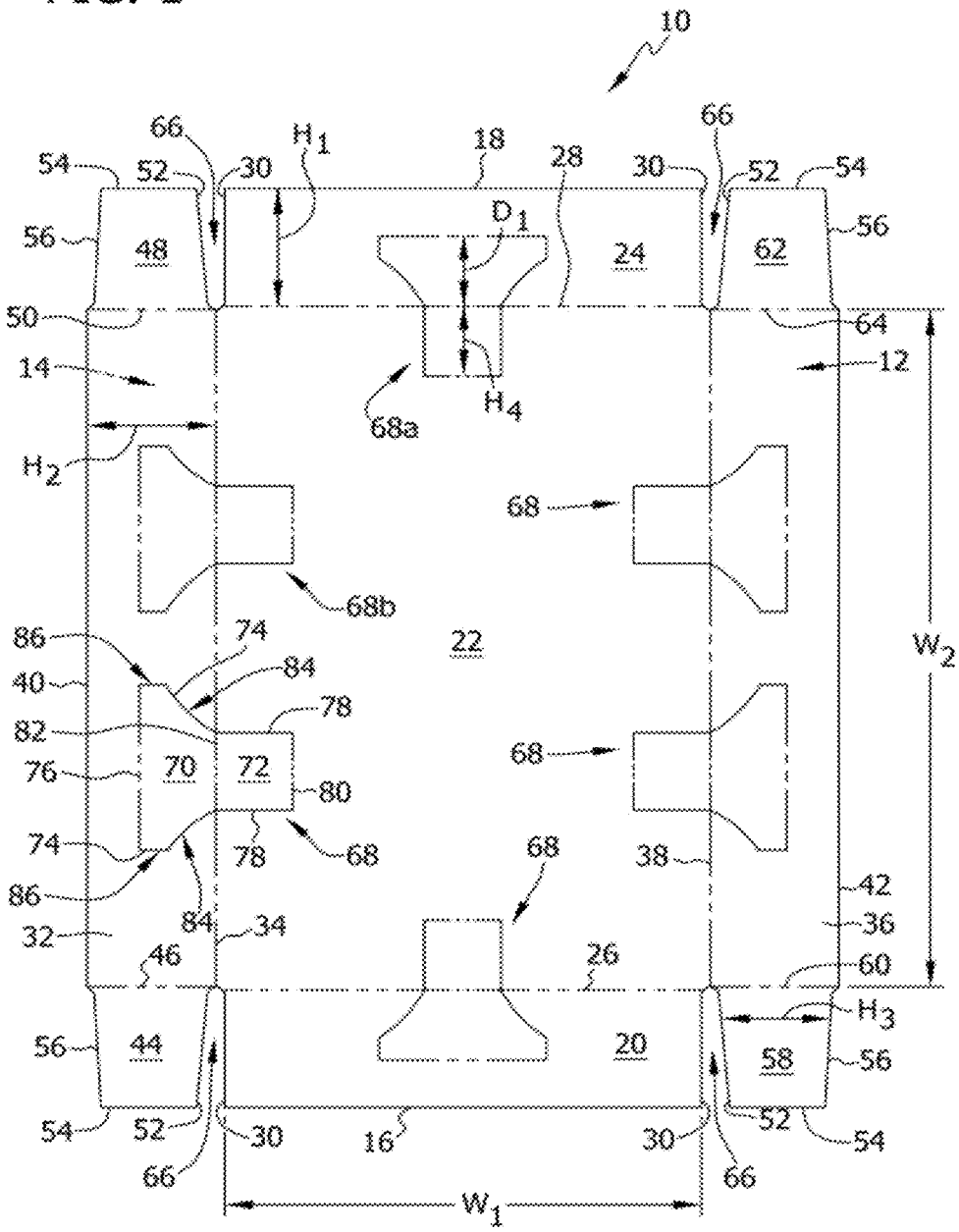
FIGS. 1-12 show exemplary embodiments of the blanks, trays, and methods described herein.
Figure 6:
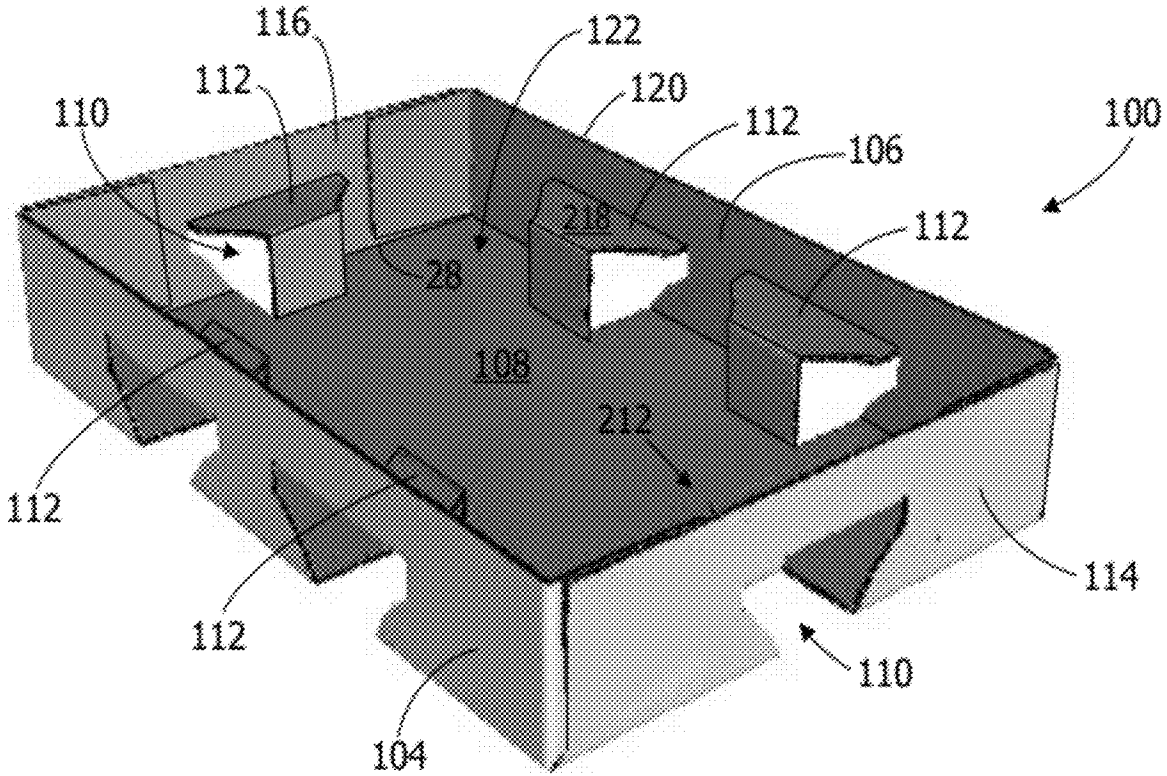

Referring now to the drawings, FIG. 1 is a top view of an exemplary blank 10 of sheet material for forming a tray, such as a tray 100 (shown in FIG. 6). Blank 10 has a first or interior surface 12 and an opposing second or exterior surface 14. Further, blank 10 defines a first edge 16 and an opposing second edge 18. In one embodiment, blank 10 includes, in series from first edge 16 to second edge 18, a first end panel 20, a bottom panel 22, and a second end panel 24 coupled together along preformed, generally parallel, fold lines 26 and 28, respectively. More specifically, first end panel 20 extends from first edge 16 to fold line 26, bottom panel 22 extends from first end panel 20 along fold line 26, second end panel 24 extends from bottom panel 22 along fold line 28 to second edge 18. Fold lines 26 and/or 28, as well as other fold lines and/or hinge lines described herein, may include any suitable line of weakening and/or line of separation known to those skilled in the art and guided by the teachings herein provided. In the exemplary embodiment, each end panel 20 and 24 includes free side edges 30. When tray 100 is formed from blank 10, fold line 26 defines a bottom edge of first end panel 20 and a first end edge of bottom panel 22; fold line 28 defines a second end edge of bottom panel 22 and a bottom edge of second end panel 24; first edge 16 defines a top edge of first end panel 20; and second edge 18 defines a top edge of second end panel 24.

A first side panel 32 extends from a first side edge of bottom panel 22 at a fold line 34, and a second side panel 36 extends from a second side edge of bottom panel 22 at a fold line 38. Fold lines 34 and 38 are substantially parallel. First side panel 32 has a free edge 40 that defines a top edge of first side panel 32 when tray 100 is formed, and second side panel 36 has a free edge 42 that defines a top edge of second side panel 36 when tray 100 is formed. A first end flap 44 extends from an end edge of first side panel 32 at a fold line 46, and a second end flap 48 extends from an opposing end edge of first side panel 32 at a fold line 50. Each end flap 44 and 48 includes free edges 52, 54, and 56. Similarly, a third end flap 58 extends from an end edge of second side panel 36 at a fold line 60, and a fourth end flap 62 extends from an opposing end edge of second side panel 36 at a fold line 64. Each end flap 58 and 62 includes free edges 52, 54, and 56. In the exemplary embodiment, each end flap 44, 48, 58, and 62 is separated from an adjacent end panel 20 or 24 by a gap 66; however, it should be understood that any of end flaps 44, 48, 58, and/or 62 can be separated from an adjacent end panel 20 or 24 by a cut line without gap 66.

Each end panel 20 and 24 has a height $H_1$, and each side panel 32 and 36 has a height $H_2$. In the exemplary embodiment, height $H_1$ is substantially equal to height $H_2$. Alternatively, height $H_1$ is other than substantially equal to height $H_2$, for example less than or greater than height $H_2$. In the exemplary embodiment, end flaps 44, 48, 58, and 62 each have a height $H_3$ that is approximately equal to, or slight smaller than height $H_1$. Further, end panels 20 and 24 each have a width $W_1$, and side panels 32 and 36 each have a width $W_2$ that is larger than width $W_1$. Alternatively, width $W_2$ is equal to or less than width $W_1$ depending on what type and/or how many products tray 100 supports therein.

Blank 10 further includes a plurality of divider panel assemblies 68. In the exemplary embodiment, blank 10 includes a first divider panel assembly **68*a* defined within at least one end panel 20 and/or 24 and a second divider panel assembly 68*b* defined within at least one side panel 32 and/or 36. Each divider panel assembly 68*a* and 68*b* is configured similarly and is referred to generically as divider panel assembly 68 for the sake of simplicity. In the exemplary embodiment, each end panel 20 and 24 includes one divider panel assembly 68, and each side panel 32 and 36 includes a plurality of divider panel assemblies 68. Alternatively, each side panel 32 and 36 includes one divider panel assembly 68 such that tray 100 is configured to support four containers. In the exemplary embodiment, divider panel assemblies 68 have any suitable size and/or configuration based on the containers supported by tray 100. Further, divider panel assemblies 68 are configured to cooperate with an adjacent divider panel assembly 68 to secure the containers within tray 100. For example, each of the containers is contacted by two divider panel assemblies 68**.

In the exemplary embodiment, each divider panel assembly 68 includes an upper panel 70 defined within a panel 20, 24, 32, and/or 36 and an inner panel 72 defined within bottom panel 22. More specifically, upper panel 70 is defined within a panel 20, 24, 32, and/or 36 by side cut lines 74 and a fold line 76. Inner panel 72 is defined within bottom panel 22 by side cut lines 78 and a fold line 80. Side cut lines 78 are continuous with side cut lines 74 across a respective fold line 26, 28, 34, and/or 38. Upper panel 70 and inner panel 72 are connected to each other at a fold line 82 that is substantially collinear with a respective fold line 26, 28, 34, or 38. Alternatively, fold line 82 is offset from a respective fold line 26, 28, 34, or 38. In the exemplary embodiment, a depth $D_1$ of upper panel 70 is substantially equal to a height $H_4$ of inner panel 72 such that upper panel 70 is substantially perpendicular to inner panel 72 when a divider structure 212 (shown in FIG. 6). In an alternative embodiment, depth $D_1$ is other than equal to height $H_4$ such that upper panel 70 is at an acute or an obtuse angle to inner panel 72.

Upper side cut lines 74 include at least a curved portion 84 to correspond to a shape of the products supported by tray 100. In the exemplary embodiment, upper side cut lines 74 include curved portion 84 and a substantially straight portion 86. More specifically, curved portion 84 has an edge configured to interface with or engage a container supported within tray 100. As such, curved portion 84 of upper side cut lines 74 defines an engagement edge of divider panel assembly 68. Engagement edges of adjacent divider panel assemblies 68 are configured to cooperate with each other to secure a container within in tray 100, as described in more detail below. In the exemplary embodiment, first divider panel assembly 68*a* includes a first engagement edge defined by curved portion 84 and second divider panel assembly 68*b* includes a second engagement edge defined by curved portion 84 adjacent to the first engagement edge. The first engagement edge and the second engagement edge are configured to cooperate with each other to secure a product between first divider panel assembly 68*a* and second divider panel assembly 68*b* in the erected configuration. Further, substantially straight portion 86 is configured to space the products from a wall of tray 100. Upper side cut lines 74 define free side edges of upper panel 70 when tray 100 is formed as described below. Inner side cut lines 78 are substantially straight and define free side edges of inner panel 72 when tray 100 is formed. Inner panel 72 has a width between side cut lines 78 based on a size of the containers supported by tray 100.

When blank 10 is in a flat, unformed state, divider panel assemblies 68 are in a flat configuration. More specifically, upper panel 70 is coplanar with a respective panel 20, 24, 32, or 36 and inner panel 72 is coplanar with bottom panel 22 in the flat configuration.

Figure 2:
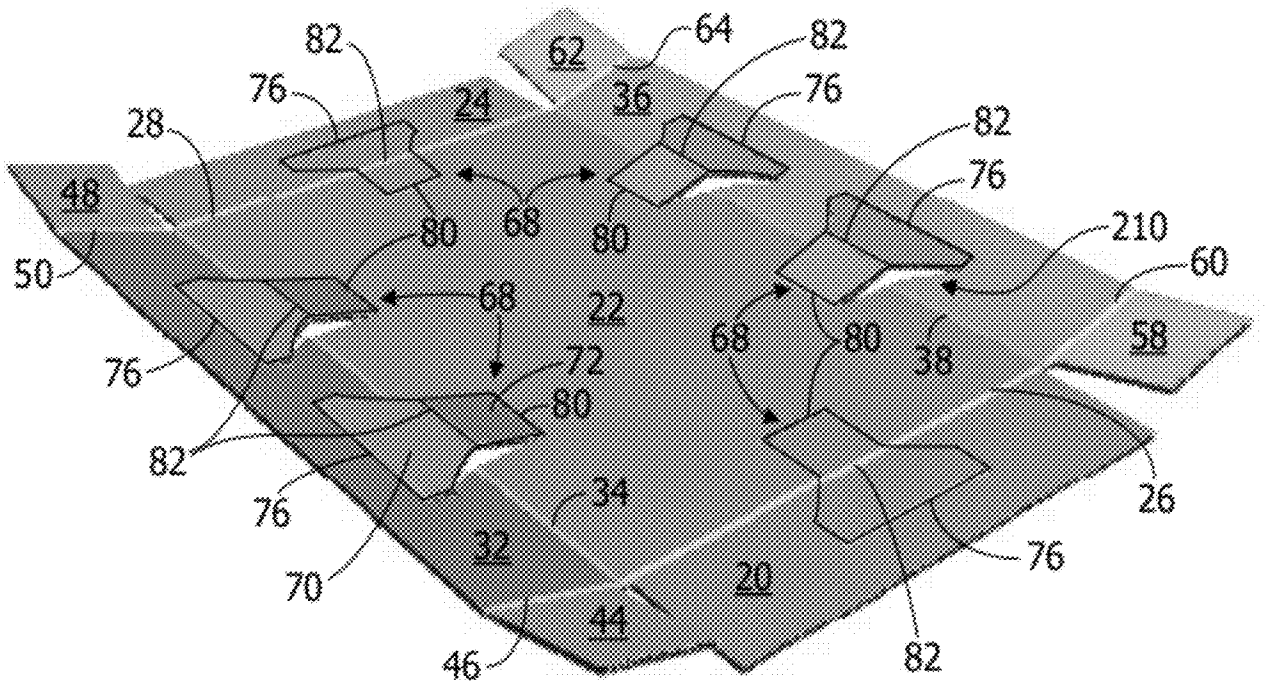
Figure 3:
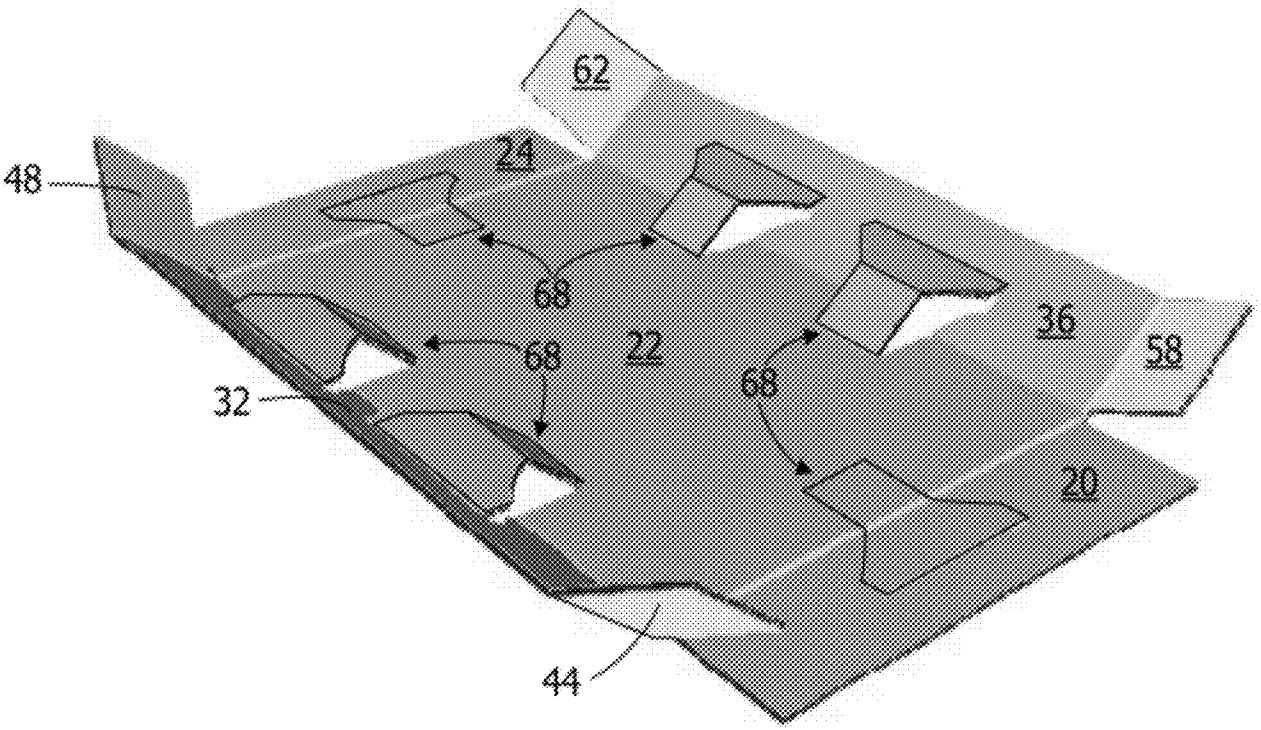
Figure 4:
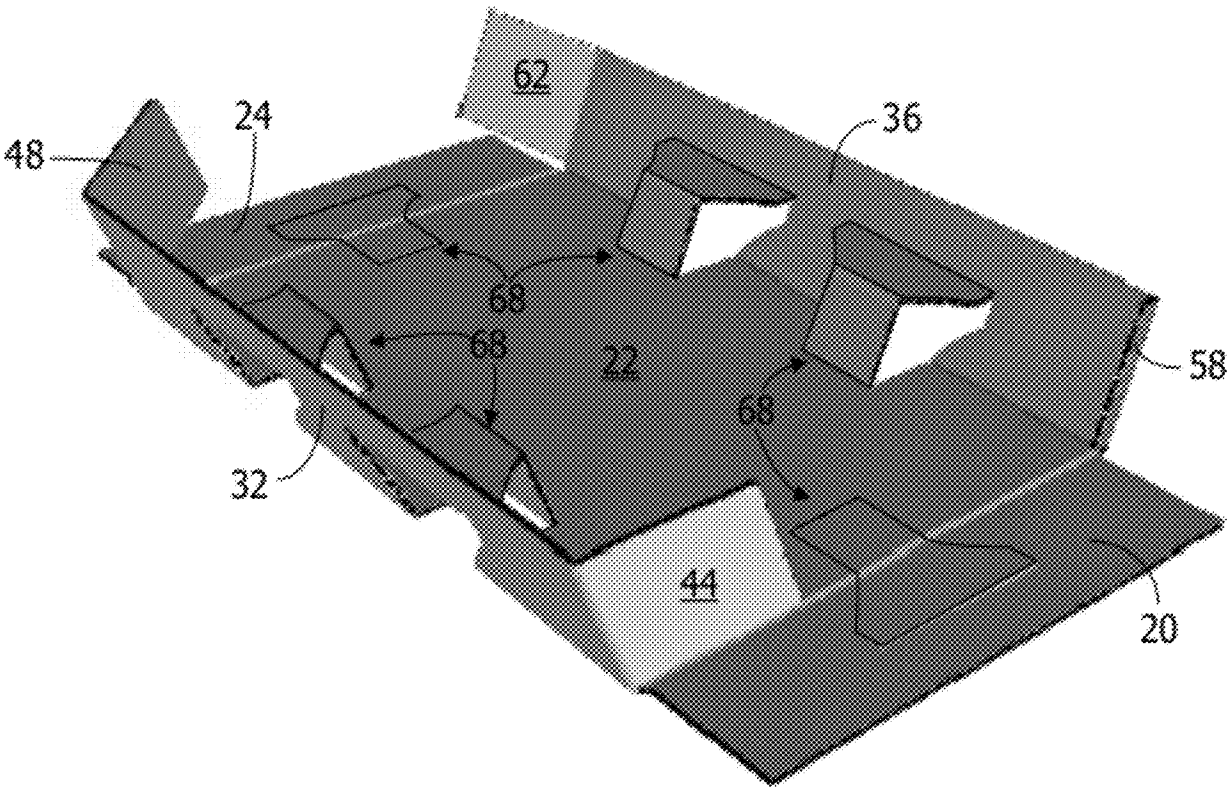
Figure 5:
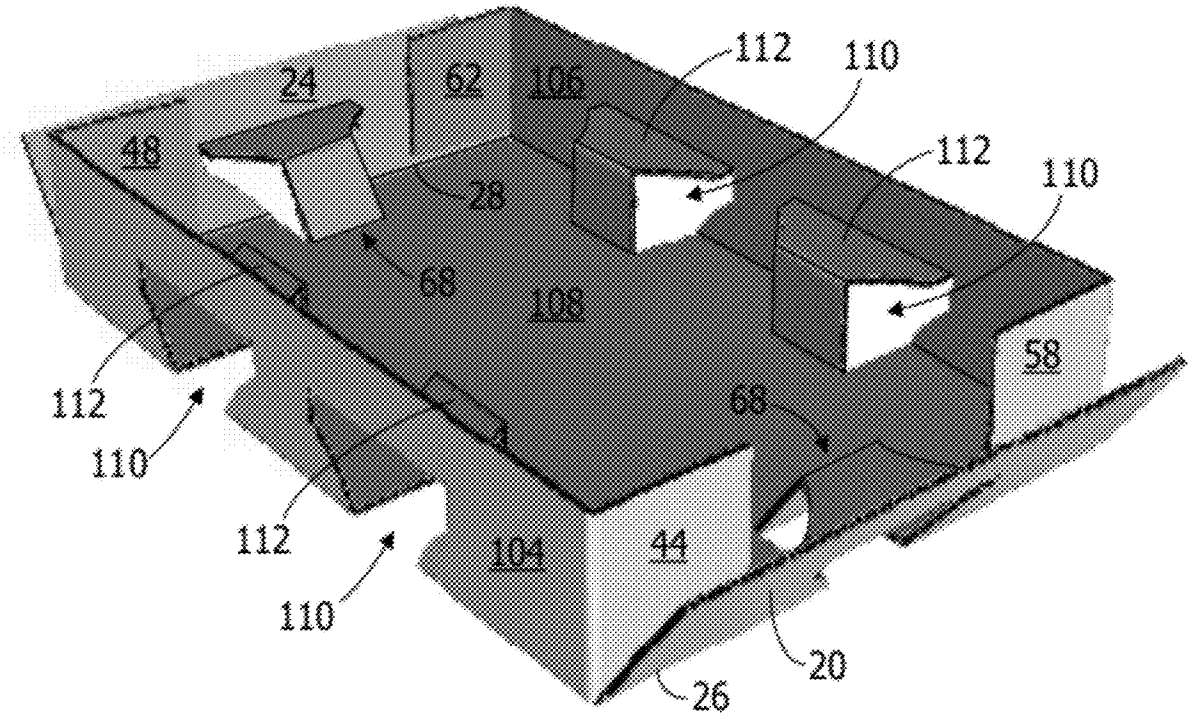
Figure 7:
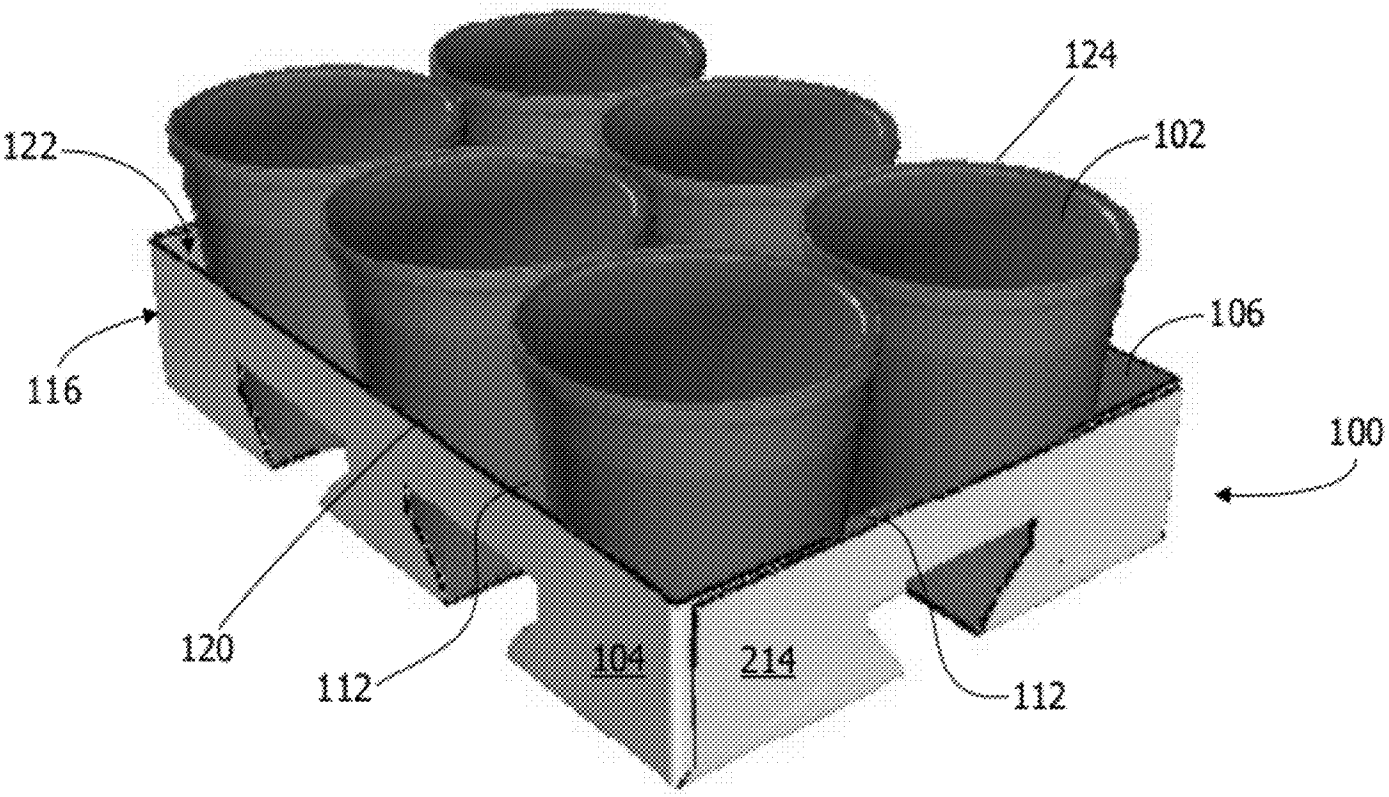

FIG. 2 is a perspective view of blank 10 (shown in FIG. 1) at a first stage of construction. FIG. 3 is a perspective view of blank 10 at a second stage of construction. FIG. 4 is a perspective view of blank 10 at a third stage of construction. FIG. 5 is a perspective view of blank 10 at a fourth stage of construction. FIG. 6 is a perspective view of an exemplary tray 100 formed from blank 10. FIG. 7 is a perspective view of tray 100 having container and/or products 102 therein. The herein-described method for forming tray 100 from blank 10 can be performed manually and/or automatically.

Referring to FIGS. 1-7, to construct tray 100 from blank 10, side panels 32 and 36 are rotated about fold lines 34 and 38 toward bottom panel 22 to be substantially perpendicular to bottom panel 22 to form a first side wall 104 and a second side wall 106. Bottom panel 22 forms a bottom wall 108. As side panels 32 and 36 are rotated, divider panel assemblies 68 begin to buckle inwardly at fold lines 76, 80, and 82, as shown in FIGS. 2-4. More specifically, interior surface 12 of upper panel 70 rotates about fold line 76 toward interior surface 12 of a respective side panel 32 or 36, and interior surface 12 of inner panel 72 rotates about fold line 80 toward interior surface 12 of bottom panel 22. Upper panel 70 and inner panel 72 rotate with respect to each other at fold line 82. As divider panel assemblies 68 begin to buckle, an opening 110 is formed at each divider panel assembly 68 in bottom wall 108 and a respective side wall 104 or 106.

When side panels 32 and 36 are substantially perpendicular to bottom panel 22, upper panels 70 are at an angle, such as a right angle, to a respective side wall 104 or 106 and inner panels 72 are at an angle, such as a right angle, to bottom wall 108. In the exemplary embodiment shown in FIG. 5, upper panels 70 are substantially parallel to bottom wall 108 and inner panels 72 are substantially parallel to side walls 104 and 106. As such, upper panels 70 are substantially perpendicular to inner panels 72. Alternatively, upper panels 70 are at any suitable angle to inner panels 72. Such a configuration of divider panel assemblies 68 is referred to as an erected configuration. In the erected configuration, divider panel assemblies 68 form divider structures 112 associated with side walls 104 and 106.

End flaps 44, 48, 58, and 62 are rotated about fold lines 46, 50, 60, and 64 to be substantially perpendicular to a respective side panel 32 or 36. In the exemplary embodiment as shown in FIGS. 2-5, end flaps 44, 48, 58, and 62 are rotated as side panels 32 and 36 are rotated; however, it should be understood that end flaps 44, 48, 58, and/or 62 can be additionally or alternatively rotated before and/or after side panels 32 and 36 are rotated. In a particular embodiment, end flaps 44, 48, 58, and 62 are not rotated until end panels 20 and 24 are rotated as described below. In such an embodiment, end flaps 44, 48, 58, and 62 are secured to exterior surface 14 of end panels 20 and 24, rather than secured to interior surface 12 of end panels 20 and 24, as described herein. In the exemplary embodiment, when side panels 32 and 36 are substantially perpendicular to bottom panel 22, end flaps 44, 48, 58, and 62 are also substantially perpendicular to bottom panel 22, as shown in FIG. 5.

End panels 20 and 24 are rotated about fold lines 26 and 28 toward bottom panel 22 to be substantially perpendicular to bottom wall 108. Exterior surface 14 of end flaps 44, 48, 58, and 62 are coupled to interior surface 12 of an adjacent end panel 20 and/or 24 to form a first end wall 114 and a second end wall 116. More specifically, first end wall 114 includes first end panel 20, first end flap 44, and third end flap 58. Similarly, second end wall 116 includes second end panel 24, second end flap 48, and fourth end flap 62. In the exemplary embodiment, end walls 114 and 116 and side walls 104 and 106 have substantially the same height.

As end panels 20 and 24 are rotated, divider panel assemblies 68 associated with end panels 20 and 24 begin to buckle inwardly at fold lines 76, 80, and 82, as shown in FIG. 5. More specifically, interior surface 12 of upper panel 70 rotates about fold line 76 toward interior surface 12 of a respective end panel 20 or 24, and interior surface 12 of inner panel 72 rotates about fold line 80 toward interior surface 12 of bottom panel 22. Upper panel 70 and inner panel 72 rotate with respect to each other at fold line 82. As divider panel assemblies 68 begin to buckle, opening 110 is formed at each divider panel assembly 68 in bottom wall 108 and a respective end wall 114 or 116. When end panels 20 and 24 are substantially perpendicular to bottom wall 108, upper panels 70 are at an angle, such as a right angle, to a respective end wall 114 or 116 and inner panels 72 are at an angle, such as a right angle, to bottom wall 108. In the exemplary embodiment shown in FIG. 6, upper panels 70 are substantially parallel to bottom wall 108 and inner panels 72 are substantially parallel to end walls 114 and 116. As such, upper panels 70 are substantially perpendicular to inner panels 72. In the erected configuration, divider panel assemblies 68 form divider structures 112 associated with end walls 114 and 116.

In the exemplary embodiment, an upper surface 118 of each divider structure 112 is below a top edge 120 of walls 104, 106, 114, and 116. Further, each upper panel 70 is at angle to a respective wall 104, 106, 114, or 116, and each inner panel 72 is at an angle to bottom wall 108. In the exemplary embodiment, the angles are substantially right angles; however, the angles can be any suitable angle that is other than 0° or 180°.

Products 102 are positioned within a cavity 122 of tray 100 between at least two divider structures 112 as shown in FIG. 7. When products 102 are positioned in tray 100, the free side edges of upper panels 70 act as engagement edges and contact sides of products 102 to secure products 102 within tray 100. In the exemplary embodiment, adjacent engagement edges of two adjacent divider structures 112 cooperate to secure product 102 within tray 100. Further, products 102 are spaced from walls 104, 106, 114, and 116 by upper panels 70. Further, top edge 120 of walls 104, 106, 114, and 116 is below a top 124 of products 102. Although the exemplary embodiments are described herein as being configured to support six products 102, it should be understood that blank 10 and tray 100 can be configured to contain four or more products 102.

At least on divider structure 112 can be collapsed to provide tray 100 having at least one less opening 110. More specifically, a force is applied to interior surface 12 around fold line 82 to rotate upper panel 70 about fold line 76 and inner panel 72 about fold line 80 until upper panel 70 is substantially coplanar with a respective panel 20, 24, 32, or 36 and inner panel 72 is substantially coplanar with bottom panel 22. Such a configuration is referred to as a collapsed configuration, and may be used to store or transport trays 100. In the collapsed configuration, inner panel 72 forms a portion of bottom wall 108, and upper panel 70 forms a portion of an associated wall 104, 106, 114, or 116. Divider structures 112 can be re-formed to the erected configuration by applying a force to exterior surface 14 around fold line 82 to rotate upper panel 70 about fold line 76 and inner panel 72 about fold line 80 until upper panel 70 is substantially perpendicular to a respective wall 104, 106, 114, or 116 and inner panel 72 is substantially perpendicular to bottom wall 108.

Figure 8:
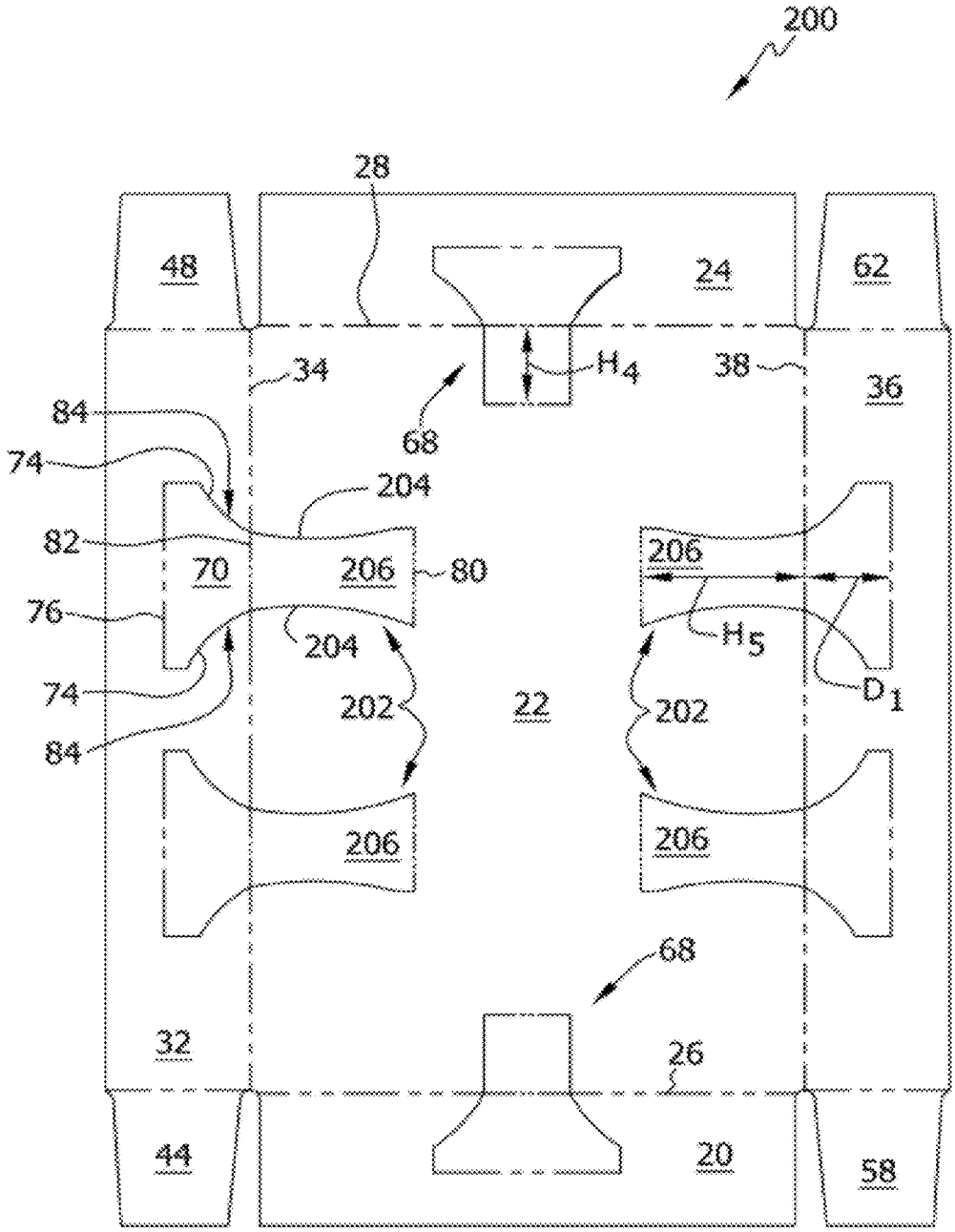

FIG. 8 is a top view of a first alternative blank 200 of sheet material for forming a tray (not shown). Blank 200 is substantially similar to blank 10 (shown in FIG. 1), except blank 200 includes a plurality of divider panel assemblies 202. As such, components shown in FIG. 8 are labeled with the same reference numbers used in FIG. 1. In the exemplary embodiment, divider panel assembly 202 is substantially similar to divider panel assembly 68 (shown in FIG. 1), except divider panel assembly 202 includes side cut lines 204 that are arcuate and/or curved rather than being substantially straight, like side cut lines 78 (shown in FIG. 1). Inner side cut lines 204 are a continuous curved with upper side cut lines 74. Alternatively, inner side cut lines 204 can have a different curve than, and/or a curve that is not continuous with, curved portion 84 of upper side cut lines 74.

Side cut lines 204 are curved because an inner panel 206 of each divider panel assembly 202 has a height $H_5$ that is longer than depth $D_1$ of upper panel 70. As such, inner panel 206 will be at acute angles to bottom panel 22 and upper panel 70 when a tray 250 (shown in FIGS. 9 and 10) is formed from blank 200. In the exemplary embodiment, divider panel assemblies 202 are defined in side panels 32 and 36, divider panel assemblies 68 are defined in end panels 20 and 24. Alternatively, blank 200 includes divider panel assemblies 202 defined in side panels 32 and 36 and in end panels 20 and 24. Because inner panel 206 slopes back to the side edges of bottom panel 22 when tray 250 is formed, side cuts lines 204 are configured to conform to a contour diagonally across a side wall of the products within tray 250.

Figure 9:
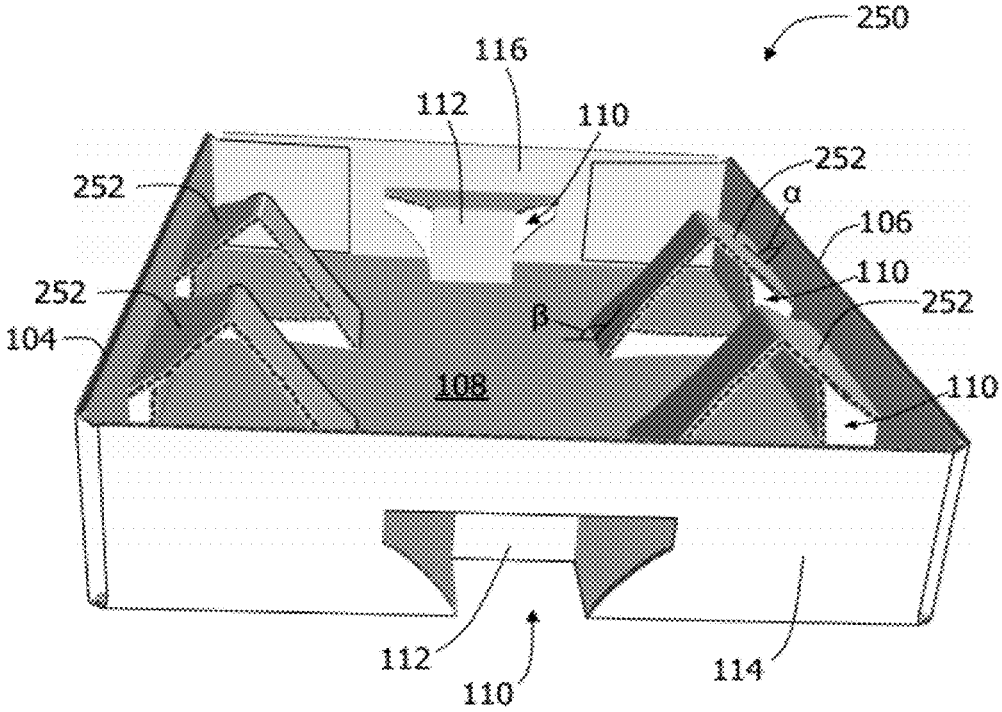
Figure 10:
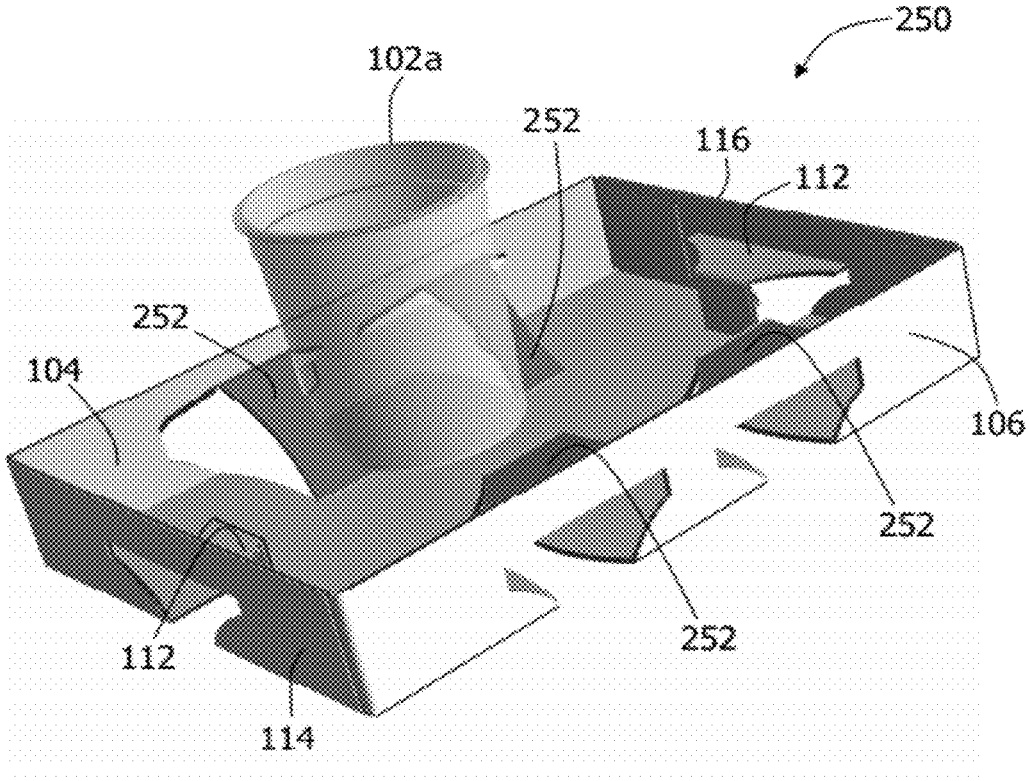

FIG. 9 is a perspective view of tray 250 formed from blank 200 (shown in FIG. 8). FIG. 10 is a perspective view of tray 250 having products 102 therein. Tray 250 is formed substantially similar to tray 100 (shown in FIG. 6), except tray 250 includes a plurality of divider structures 252. As such, components shown in FIGS. 9 and 10 are labeled with the same reference numbers used in FIGS. 6 and 7. In the exemplary embodiment, divider structures 252 extend from at least side walls 104 and 106. Divider structures 252 are each configured such that upper panel 70 is at an acute angle $\alpha$ to a respective side wall 104 or 106, and inner panel 206 is at an obtuse angle $\beta$ with respect to bottom wall 108. Further, each upper panel 70 is at a substantially right angle to a respective wall 114 or 116, and each inner panel 72 is at a substantially right angle to bottom wall 108. However, it should be understood that the angles can be any suitable angle that is other than 0° or 180°.

Divider structures 252 are beneficial to contact more of product 102 as compared to divider structures 112 and isolate a center round tub product 102*a* in all directions in a horizontal plane.

Figure 11:
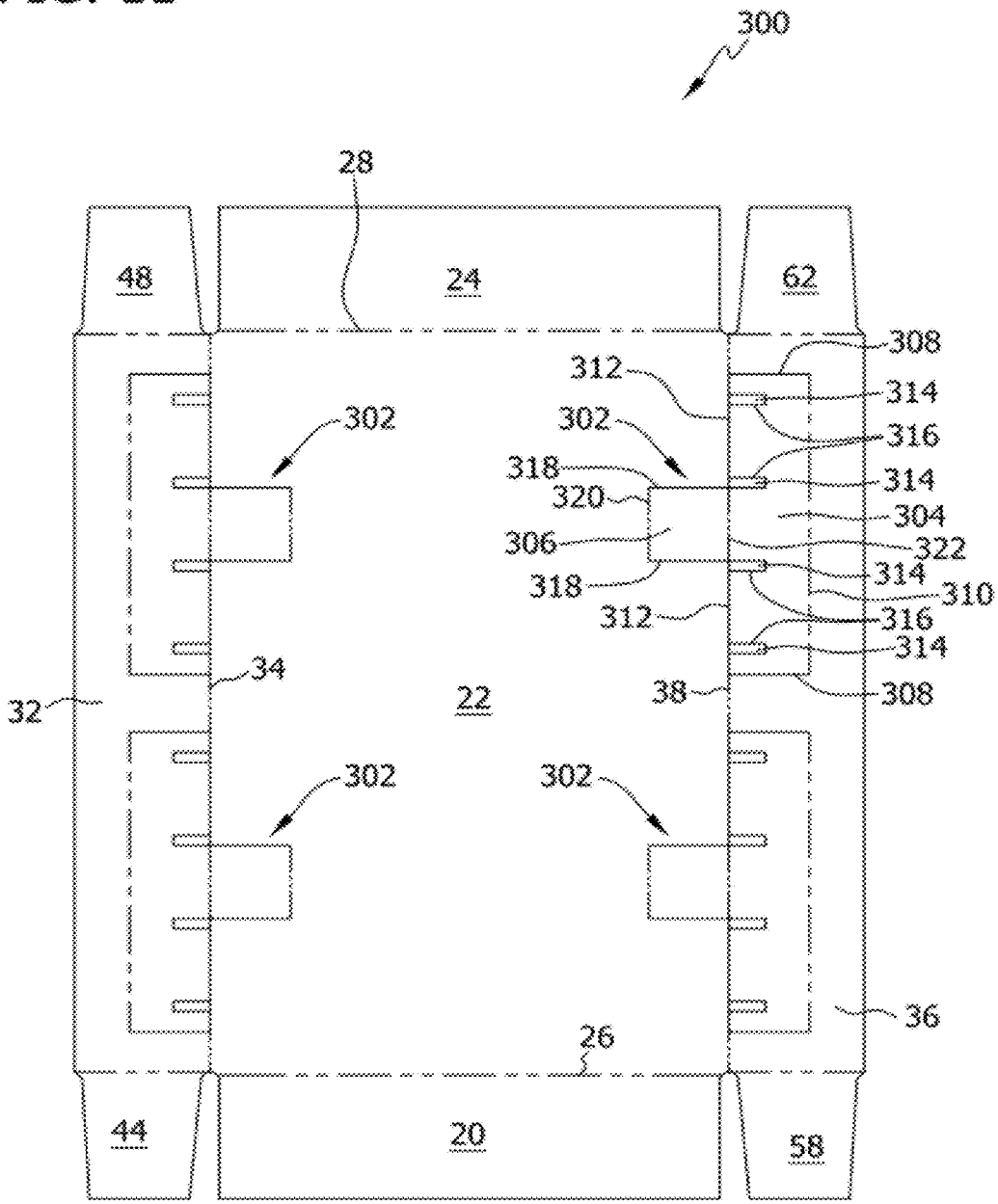
Figure 12:
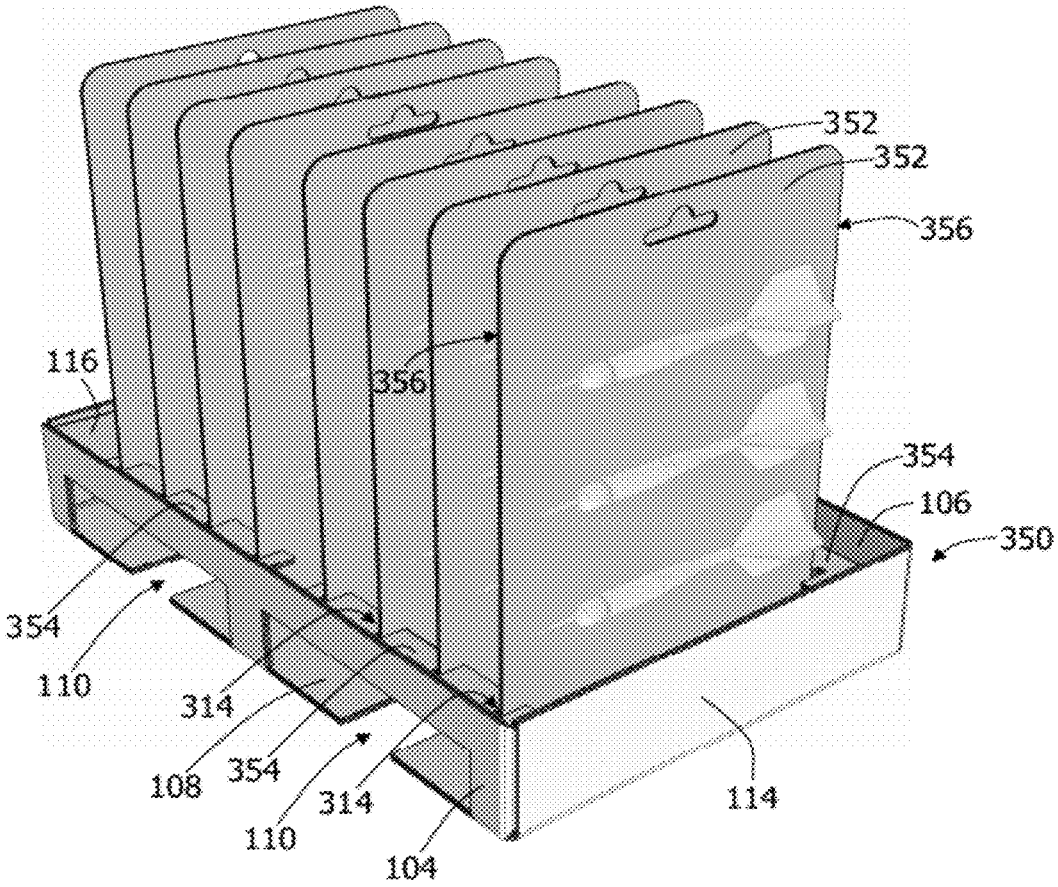

FIG. 11 is a top view of a second alternative blank 300 of sheet material for forming a tray 350 (shown in FIG. 12). Tray can 350 be configured to support a plurality of cards, blister packs, and/or other suitable elongated products, such as products 352 (shown in FIG. 12) therein. Blank 300 is substantially similar to blank 10 (shown in FIG. 1), except blank 300 includes a plurality of divider panel assemblies 302. As such, components shown in FIG. 11 are labeled with the same reference numbers used in FIG. 1.

In the exemplary embodiment, divider panel assembly 302 includes an upper panel 304 defined within side panel 32 or 36 and an inner panel 306 defined within bottom panel 22. More specifically, upper panel 304 is defined within panel 32 or 36 by side cut lines 308 and a fold line 310. Cut lines 312 separate upper panel 304 from bottom panel 22. In the exemplary embodiment, cut lines 312 are substantially collinear with a respective fold line 34 or 38; however, it should be understood that at least one cut line 312 can be offset from a respective fold line 34 or 38. Side cut lines 308 are substantially straight and configured to space products from a wall 104 and/or 106 (shown in FIG. 12) of tray 350. Upper side cut lines 308 define free side edges of upper panel 304 when tray 350 is formed.

In the exemplary embodiment, slots 314 are defined within upper panel 304 by cut lines 316 and cut lines 312. More specifically, slots 314 extend inwardly a distance from cut line 312 toward fold line 310. Slots 314 are substantially rectangular in the exemplary embodiment; however slots 314 can have any suitable configuration depending on a configuration of a product supported within the tray. In a particular embodiment, slots 314 are configured to contact a side edge of a product 352 supported in tray 350 to secure product 352 within tray 350. In the exemplary embodiment, slots 314 are equally spaced apart along side panel 32 or 36 regardless of whether slots 314 are on same divider panel assembly 302 or on adjacent divider panel assemblies 302. Alternatively, at least two adjacent slots 314 have a spacing different than the spacing between another two adjacent slots 314. In the exemplary embodiment, each slot 314 defines an engagement edge of divider panel assembly 302 that is configured to engage a product positioned within tray 350 formed from blank 300.

Inner panel 306 is defined within bottom panel 22 by side cut lines 318 and a fold line 320. Side cut lines 318 are continuous with an adjacent slot cut line 316 across a respective fold line 34 or 38. Upper panel 304 and inner panel 306 are connected to each other at a fold line 322 that is substantially collinear with cut lines 312 and/or fold line 34 or 38. Alternatively, fold line 322 is offset from cut lines 312 and/or fold line 34 or 38. In the exemplary embodiment, inner side cut lines 318 are substantially straight and define free side edges of inner panel 306 when the tray is formed. Inner panel 306 has a width between side cut lines 318 based on a size of the products supported by tray 350.

FIG. 12 is a perspective view of tray 350 having products 352 therein. Tray 350 is formed substantially similar to tray 100 (shown in FIG. 6), except tray 350 includes a plurality of divider structures 354. As such, components shown in FIG. 12 are labeled with the same reference numbers used in FIGS. 6 and 7. In the exemplary embodiment, divider structures 354 extend from at least side walls 104 and 106. Divider structures 354 are each configured such that slots 314 of divider structures 354 contact a side edge region 356 of product 352 supported in tray 350 to secure product 352 within tray 350. For example, opposing side edges 356 of product 352 are secured by opposing divider panel assemblies 302 at slots 314. In the exemplary embodiment, each upper panel 304 is at angle to a respective wall 104 or 106, and each inner panel 306 is at an angle to bottom wall 108. In the exemplary embodiment, the angles are substantially right angles and, as such, upper panel 304 is substantially perpendicular to side wall 104 or 106 and inner panel 306 is substantially perpendicular to bottom wall 108 when divider structure 354 is formed. However, the angles can be any suitable angle that is other than 0° or 180°. For example, upper panel 304 is at an acute or obtuse angle to side wall 104 or 106 and inner panel 306 is at an acute or obtuse angle to bottom wall 108 when divider structure 354 is formed.

The above-described embodiments provide a tray for supporting a plurality of containers and/or products using less material than is used in known tube-type trays. More specifically, the divider panel assemblies defined within the side, end, and bottom panels do not require a plurality of panels to form a tube. Further, because each container is contacted by two divider structures configured to correspond to the shape of the container, the container is more securely supported within the tray, as compared to trays using the side and end walls in conjunction with one holder to secure a container.

Exemplary embodiments of a tray for supporting containers and a blank for making the same are described above in detail. The methods, blanks, and trays are not limited to the specific embodiments described herein, but rather, components of blanks and/or trays and/or steps of the methods may be utilized independently and separately from other components and/or steps described herein. Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a tray, the blank comprising:

a bottom panel;

a pair of opposing end panels connected to the bottom panel;

a pair of opposing side panels connected to the bottom panel;

a first divider panel assembly defined within the bottom panel and a first end panel of the pair of end panels, the first divider panel assembly comprising a first upper panel and a first inner panel connected at a first fold line, the first upper panel defined within the first end panel and the first inner panel defined within the bottom panel, wherein the first upper panel is configured to be at a first angle to the first end panel and the first inner panel is configured to be at a second angle to the bottom panel in an erected configuration; and a second divider panel assembly defined within the bottom panel and a first side panel of the pair of side panels, the second divider panel assembly comprising a second upper panel and a second inner panel connected at a second fold line, the second upper panel defined within the first side panel and the second inner panel defined within the bottom panel, wherein the second upper panel is configured to be at a third angle to the first side panel and the second inner panel is configured to be at a fourth angle to the bottom panel in the erected configuration, wherein the second divider panel assembly comprises a first engagement edge defined along a side edge of the second upper panel extending from the first side panel to the second fold line, the first engagement edge comprising a curved portion along the side edge of the second upper panel, the first engagement edge configured to cooperate with an engagement edge of at least one divider panel assembly adjacent to the second divider panel assembly to secure a product between the second divider panel assembly and the at least one adjacent divider panel assembly in the erected configuration.

2. A blank in accordance with claim 1, wherein the first divider panel assembly comprises a second engagement edge adjacent to the first engagement edge, the first engagement edge and the second engagement edge configured to cooperate with each other to secure a product between the first divider panel assembly and the second divider panel assembly in the erected configuration.

3. A blank in accordance with claim 1, wherein the third angle is different than the fourth angle, and side edges of the second inner panel are curved to correspond to a shape of a product to be supported in the tray.

4. A blank in accordance with claim 1, wherein the first angle, the second angle, the third angle, and the fourth angle are each substantially right angles.

5. A blank in accordance with claim 1 further comprising an end flap extending from each side edge of each side panel of the pair of side panels.

6. A blank in accordance with claim 1, further comprising a plurality of divider panel assemblies defined within each side panel of the pair of side panels.

7. A tray formed from a blank of sheet material, the tray comprising:

a bottom wall;

a pair of opposing end walls connected to the bottom wall;

a pair of opposing side walls connected to the bottom wall;

a first divider structure extending from the bottom wall and a first end wall of the pair of end walls, the first divider structure comprising a first upper panel and a first inner panel connected at a first fold line, the first upper panel at a first angle to the first end wall and the first inner panel at a second angle to the bottom wall; and a second divider structure extending from the bottom wall and a first side wall of the pair of side walls, the second divider structure comprising a second upper panel and a second inner panel connected at a second fold line, the second upper panel at a third angle to the first side wall and the second inner panel at a fourth angle to the bottom wall, wherein the second divider structure comprises a first engagement edge defined along a side edge of the second upper panel extending from the first side wall to the second fold line, the first engagement edge comprising a curved portion along the side edge of the second upper panel, the first engagement edge configured to cooperate with an engagement edge of at least one divider structure adjacent to the second divider structure to secure a product between the second divider structure and the at least one adjacent divider structure.

8. A tray in accordance with claim 7, wherein the first divider structure and the second divider structure are adjacent, the first divider structure including a second engagement edge adjacent to the first engagement edge, the first engagement edge and the second engagement edge configured to engage a product within said tray to support the product between the first divider structure and the second divider structure.

9. A tray in accordance with claim 7, wherein at least one of the first divider structure and the second divider structure is configured to space a product a distance from the respective end wall or side wall from which the at least one divider structure extends, and to secure the product within the tray.

10. A tray in accordance with claim 7, wherein the first angle and the second angle are substantially right angles, and the third angle is different than the fourth angle.

11. A tray in accordance with claim 7, further comprising a plurality of divider structures extending from each end wall of the pair of end walls and each side wall of the pair of side walls, each divider structure of the plurality of divider structures comprising an engagement edge configured to cooperate with an engagement edge of an adjacent divider structure of the plurality of divider structures to secure a product within the tray.

12. A method for forming a tray from a blank of sheet material, the blank of sheet material including a bottom panel, a pair of opposing end panels connected to the bottom panel, a pair of opposing side panels connected to the bottom panel, a first divider panel assembly defined within the bottom panel and a first side panel of the pair of side panels, and a second divider panel assembly defined within the bottom panel and a first end panel of the pair of end panels, the first divider panel assembly including a first upper panel defined within the first side panel, a first inner panel defined within the bottom panel, and a first engagement edge configured to cooperate with an engagement edge of at least one divider panel assembly adjacent to the first divider panel assembly to secure a product between the first divider panel assembly and the at least one adjacent divider panel assembly in the erected configuration, the second divider panel assembly including a second upper panel defined within the first end panel and a second inner panel defined within the bottom panel, the method comprising:

rotating the pair of side panels toward the bottom panel to form a pair of opposing side walls;

rotating the first upper panel with respect to the first side panel and the first inner panel with respect to the bottom panel to form a first divider structure including the first engagement edge, the first engagement end defined along a side edge of the first upper panel extending from the first side panel to the first inner panel, the first engagement edge including a curved portion along the side edge of the first upper panel, the first engagement edge configured to cooperate with an engagement edge of at least one divider structure adjacent to the first divider structure to secure a product between the first divider structure and the at least one adjacent divider structure;

rotating the pair of end panels toward the bottom panel to form a pair of opposing end walls; and rotating the second upper panel with respect to the first end panel and the second inner panel with respect to the bottom panel to form a second divider structure.

13. A method in accordance with claim 12, wherein rotating the pair of side panels causes the first upper panel and the first inner panel to rotate to form the first divider structure.

14. A method in accordance with claim 12, wherein the first side panel includes a plurality of divider panel assemblies, and wherein rotating the pair of side panels causes a plurality of divider structures to form from the plurality of divider panel assemblies.

15. A method in accordance with claim 12, wherein rotating the pair of end panels causes the second upper panel and the second inner panel to rotate to form the second divider structure.

16. A blank for forming a tray, the blank comprising:

a bottom panel;

a pair of opposing end panels connected to the bottom panel;

a pair of opposing side panels connected to the bottom panel; and a plurality of divider panel assemblies defined within the bottom panel and a first side panel of the pair of side panels, each divider panel assembly of the plurality of divider panel assemblies comprising an upper panel and an inner panel connected at a fold line, the upper panel defined within the first side panel and the inner panel defined within the bottom panel, the upper panel comprising a free edge and a plurality of slots defined along the free edge, the slots each defining an engagement edge, wherein the upper panel is configured to be at a first angle to the bottom panel and the inner panel is configured to be at a second angle to the bottom panel in an erected configuration.

17. A blank in accordance with claim 16 further comprising a divider panel assembly defined within the bottom panel and a first end panel of the pair of end panels.

18. A blank in accordance with claim 16, wherein the upper panel comprises free side edges that are curved to define engagement edges.

19. A blank for forming a tray for shipping and displaying a plurality of products, the blank comprising:

a bottom panel;

a pair of opposing side panels connected to the bottom panel; and at least one divider panel assembly defined within the bottom panel and a first side panel of the pair of side panels, the divider panel assembly comprising a plurality of slots configured to receive a portion of at least one of the products to secure the product within the tray.

20. A blank in accordance with claim 19, wherein the divider panel assembly comprises an upper panel and an inner panel connected at a fold line, the upper panel defined within the first side panel and the inner panel defined within the bottom panel.

21. A blank in accordance with claim 20, wherein the plurality of slots are defined in the upper panel.

22. A blank in accordance with claim 20, wherein the upper panel comprises a free edge, the plurality of slots defined along the free edge.

23. A tray formed from a blank of sheet material, the tray for shipping and displaying a plurality of products, the tray comprising:

a bottom wall;

a pair of opposing side walls connected to the bottom wall; and at least one divider structure extending from the bottom wall and a first side wall of the pair of side walls, the divider structure formed from a cut out in one of the bottom wall and the first side wall, the divider structure comprising a plurality of slots configured to receive a portion of at least one of the products to secure the product within the tray.

24. A tray in accordance with claim 23, wherein the cut out comprises a first cut out in the first side panel and a second cut out in the bottom panel, the divider structure further comprising an upper panel and an inner panel connected at a fold line, the upper panel formed from the first cut out and the inner panel formed from the second cut out.

25. A tray in accordance with claim 24, wherein the plurality of slots are defined in the upper panel.

26. A tray in accordance with claim 24, wherein the upper panel comprises a free edge, the plurality of slots defined along the free edge.

* * * * *